US007108005B1

(12) United States Patent
Christenson et al.

(10) Patent No.: US 7,108,005 B1
(45) Date of Patent: Sep. 19, 2006

(54) VEHICLE CANOPY

(76) Inventors: William B. Christenson, 8815 SE. 74th Pl., Mercer Island, WA (US) 98040-5764; Renee L. Christenson, 8815 SE. 74th Pl., Mercer Island, WA (US) 98040-5764

( * ) Notice: Subject to any disclaimer, the term of this patent is extended or adjusted under 35 U.S.C. 154(b) by 404 days.

(21) Appl. No.: 10/447,709

(22) Filed: May 28, 2003

Related U.S. Application Data

(60) Provisional application No. 60/384,009, filed on May 28, 2002.

(51) Int. Cl.
*E04H 15/06* (2006.01)
*B60P 3/34* (2006.01)

(52) U.S. Cl. ..... 135/88.13; 135/88.05; 135/88.08; 135/88.15; 296/159; 296/165

(58) Field of Classification Search ..... 135/88.01, 135/88.05, 88.08, 88.09, 88.13–88.18; 296/159–163, 296/165, 167, 187.13, 181.7, 193.12
See application file for complete search history.

(56) References Cited

U.S. PATENT DOCUMENTS 2,815,762 A * 12/1957 Smith ..... 135/88.14
3,730,196 A 5/1973 Borskey
3,968,809 A 7/1976 Beavers
4,065,166 A * 12/1977 Shoemaker ..... 296/159
4,186,758 A 2/1980 Bridgman
4,457,553 A * 7/1984 Larkin ..... 296/160
4,867,502 A 9/1989 Sylvester et al.
5,226,689 A * 7/1993 Roe et al. ..... 296/159
5,820,189 A 10/1998 Tew
5,845,958 A * 12/1998 Rudys et al. ..... 296/136.08
5,961,175 A 10/1999 Clardy, Jr.
6,179,367 B1 1/2001 Bowen
6,220,648 B1 * 4/2001 Daniel ..... 296/136.02
6,871,896 B1 * 3/2005 Owen ..... 296/26.11
6,916,059 B1 * 7/2005 Feinberg ..... 296/79

* cited by examiner

*Primary Examiner*—Winnie Yip
(74) *Attorney, Agent, or Firm*—Christensen O'Connor Johnson Kindness PLLC

(57) ABSTRACT

A canopy (100) suspended above an opening (202) in a vehicle (200) is provided. The vehicle (200) has a roof (215) and a pair of vertically hung doors (204 and 206) pivotal to an open position to create the opening in the vehicle. The canopy comprises a flexible cover (102) having a top panel (104) extending between the doors and the roof. The canopy aids in forming an enclosure bounded by the top panel, the doors, a ground surface, the opening in the vehicle, and a rear opening and a non-closable bottom opening in the enclosure permitting walk-in access to the enclosure. A support frame (106) is coupled to the cover to aid in suspending the cover above the ground surface and above the opening in the vehicle. The canopy further includes an attachment assembly (108) for coupling the cover to the vehicle. In an alternate embodiment, a canopy 400 for interfacing with a vehicle 500 having a liftgate 504 is provided.

10 Claims, 5 Drawing Sheets

VEHICLE CANOPY

CROSS-REFERENCE TO RELATED APPLICATION

This application claims the benefit of U.S. Provisional Application No. 60/384,009, filed May 28, 2002, the disclosure of which is hereby expressly incorporated by reference and priority from the filing date of which is hereby claimed under 35 U.S.C. § 119.

FIELD OF THE INVENTION

The present invention relates generally to canopy construction, and more particularly, to canopy construction involving canopies adapted to interface with a vehicle.

BACKGROUND OF THE INVENTION

The Chevrolet Suburban was introduced in 1935. The rise in popularity of sport utility vehicles since the debut of the Chevrolet Suburban has drastically increased. Typically, sport utility vehicles come with a pair of cargo doors that swing laterally outward to provide access to a rear cargo area of the vehicle. Alternately, a liftgate is provided which swings up to provide access to a rear cargo area of the vehicle. Other vehicles, such as minivans and pickup truck with canopies, also utilize rear doors, often of the liftgate variety, to provide access to the rear cargo area.

With the doors in the open position, the rear cargo area is subject to the elements. Thus the contents of the rear cargo area may be damaged from precipitation. Further, no protection from the elements is provided. Therefore, a user in proximity to the rear cargo area is subject to precipitation and sun exposure. This is especially troublesome when the user is frequently accessing the rear cargo area or performing work from the rear cargo area. Therefore, a need exists to provide a canopy system adapted to interface with the rear of the vehicle to provide protection from the elements to objects and persons in the vicinity of the rear cargo area.

One previously developed solution has been to suspend a tarp between the cargo doors or over the liftgate. While this provides some protection, it is not without its problems. For instance, the rigging of the tarp takes a significant amount of time, labor, and ingenuity to lash the tarp in place such that it can withstand the elements, most notably gusts of wind. Further, especially with cargo doors, the area of the tarp suspended between the cargo doors sags, decreasing headroom and creating a concave area to hold rainwater. The pooled water is prone to leaking through the tarp and wetting a user under the tarp or damaging contents of the rear cargo area. The weight of the pooled water can overcome the lashings and cause the tarp system to fail. Further, the tarp often flaps in the wind, causing bothersome noise and potentially scratching the vehicle. Further, the tarp system does not expand the area of coverage, i.e., either above or to the sides of the doors, since no rigid support system is provided to extend the tarp outward. Further still, there is no rigid support system to direct drainage during precipitation, leading to pooling of water as discussed above.

For these reasons, there exists a need for a canopy system adapted to interface with an opening in a vehicle that provides protection to the elements, adequately controls drainage, is easy to install and take down, is inexpensive to manufacture, reliable, and meets or exceeds the performance requirements of the end user.

SUMMARY OF THE INVENTION

One embodiment of a canopy formed in accordance with the present invention is provided. The canopy is adapted to be suspended above an opening in a vehicle. The vehicle has a roof, a first door and a second door, each door having a substantially vertically oriented hinge assembly and a top edge. Each door is pivoted about their respective hinge assembly to an open position to create the opening in the vehicle. The canopy, when assembled, comprises a flexible cover having a top panel adapted to extend between the top edges of the first and second doors and the roof to form an enclosure bounded by the top panel, first and second doors, a ground surface, the opening in the vehicle, and a rear opening and a non-closable bottom opening in the enclosure permitting walk-in access to the enclosure. A support frame is coupled to the flexible cover to suspend the flexible cover above a ground surface and above the opening in the vehicle. The canopy further includes an attachment assembly coupled to the flexible cover, the attachment assembly adapted to couple the flexible cover to the vehicle.

Another embodiment of a canopy formed in accordance with the present is provided. The canopy is adapted to be suspended above an opening in a vehicle, the vehicle having a roof, a first side, a second side, a longitudinal axis, a first door, and a second door. Each door has a substantially vertical hinge assembly and a top edge. Each door is pivoted about their respective hinge assembly to an open position to create the opening in the vehicle. The canopy includes a flexible cover having a top panel adapted to extend between the top edges of the first and second doors and the roof and a first side panel coupled to the top panel. A surface of the first side panel is inclined relative to the top panel, the surface of the first side panel adapted to extend between the first side of the vehicle, the first door, and the top panel. The flexible cover also includes a second side panel coupled to the top panel. A surface of the second side panel is inclined relative to the top panel. The surface of the second side panel is adapted to extend between the second side of the vehicle, the second door, and the top panel. The canopy forms an enclosure bounded by the top panel, first and second doors, a ground surface, the opening in the vehicle, and a rear opening and a non-closable bottom opening in the enclosure permitting walk-in access to the enclosure.

The canopy also includes a support frame coupled to the flexible cover to suspend the flexible cover above a ground surface and above the opening in the vehicle. The support frame includes a first elongate support member adapted to support a portion of the flexible cover extending between the first and second doors. The support frame also includes a second elongate support member adapted to support a portion of the flexible cover extending between the first and second doors. The second elongate support member is adapted to be oriented substantially perpendicular to the first elongate support member and substantially parallel with the longitudinal axis of the vehicle.

The canopy further includes an attachment assembly coupled to the flexible cover, the attachment assembly adapted to couple the flexible cover to the vehicle. The attachment assembly includes a first adjustable fastener. The first adjustable fastener is coupled to the flexible cover at a first location and adapted to span between the first location and a first attachment location on the roof. The first adjustable fastener is selectively adjustable in length. The attachment assembly also includes a second adjustable fastener, the second adjustable fastener coupled to the flexible cover at a second location. The second adjustable fastener is adapted to span between the second location and a second attachment location on the roof. The second adjustable fastener is selectively adjustable in length.

Yet another embodiment of a canopy formed in accordance with the present invention is provided. The canopy is adapted to be suspended above an opening in a vehicle. The vehicle has a roof, a longitudinal axis, and a door having a substantially horizontal hinge assembly, a bottom edge, and an outer surface. The door is pivoted about the hinge assembly to an open position to create the opening in the vehicle. The canopy, when assembled, includes a flexible cover having a top panel adapted to extend outward from the roof and over at least a portion of the outer surface of the door. The flexible cover also includes a first side panel coupled to the top panel. The first side panel is inclined relative to the top panel. The flexible cover also includes a second side panel coupled to the top panel. The second side panel is inclined relative to the top panel. The canopy is adapted to form an enclosure bounded by the top panel, the first side panel, the second side panel, a ground surface, the opening in the vehicle, and a rear opening and a non-closable bottom opening in the enclosure permitting walk-in access to the enclosure. The canopy further includes a support frame having an elongate support member coupled to the flexible cover to suspend the flexible cover longitudinally outward from the bottom edge of the door. The canopy further includes an attachment assembly coupled to the flexible cover, the attachment assembly adapted to couple the flexible cover to the vehicle to suspend the flexible cover above the ground surface.

Still yet another embodiment of a canopy formed in accordance with the present invention is provided. The canopy is adapted to be suspended above an opening in a vehicle. The vehicle has a roof, a longitudinal axis, and a door having a substantially horizontal hinge assembly, a bottom edge, and an outer surface. The door is pivoted about the hinge assembly to an open position to create the opening in the vehicle. The canopy includes a flexible cover including a top panel adapted to extend outward from the roof and over a portion of the outer surface of the door. The flexible cover further includes a first side panel coupled to the top panel. The first side panel is inclined relative to the outer surface of the door. The flexible cover also includes a second side panel coupled to the top panel. The second side panel is inclined relative to the outer surface of the door. The canopy is adapted to form an enclosure bounded by the top panel, the first side panel, the second side panel, a ground surface, the opening in the vehicle, and a rear opening and a non-closable bottom opening in the enclosure permitting walk-in access to the enclosure.

The canopy further includes an attachment assembly coupled to the flexible cover. The attachment assembly is adapted to couple the flexible cover to the vehicle. The attachment assembly includes a first adjustable fastener, the first adjustable fastener coupled to the flexible cover at a first location. The first adjustable fastener is adapted to span between the first location and a first attachment location on the roof. The first adjustable fastener is selectively adjustable in length. The attachment assembly further includes a second adjustable fastener, the second adjustable fastener coupled to the flexible cover at a second location. The second adjustable fastener is adapted to span between the second location and a second attachment location on the roof. The second adjustable fastener is selectively adjustable in length. The canopy also includes a first attachment mechanism coupled to the flexible cover and adapted to couple to a first corner of the door. The canopy further includes a second attachment mechanism coupled to the flexible cover and adapted to couple to a second corner of the door.

The canopy further includes a support frame coupled to the flexible cover to aid in the support of the flexible cover and to suspend the flexible cover above the ground surface. The support frame includes an elongate support member adapted to support a portion of the flexible cover outward from a bottom edge of the door.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

Figure 1:
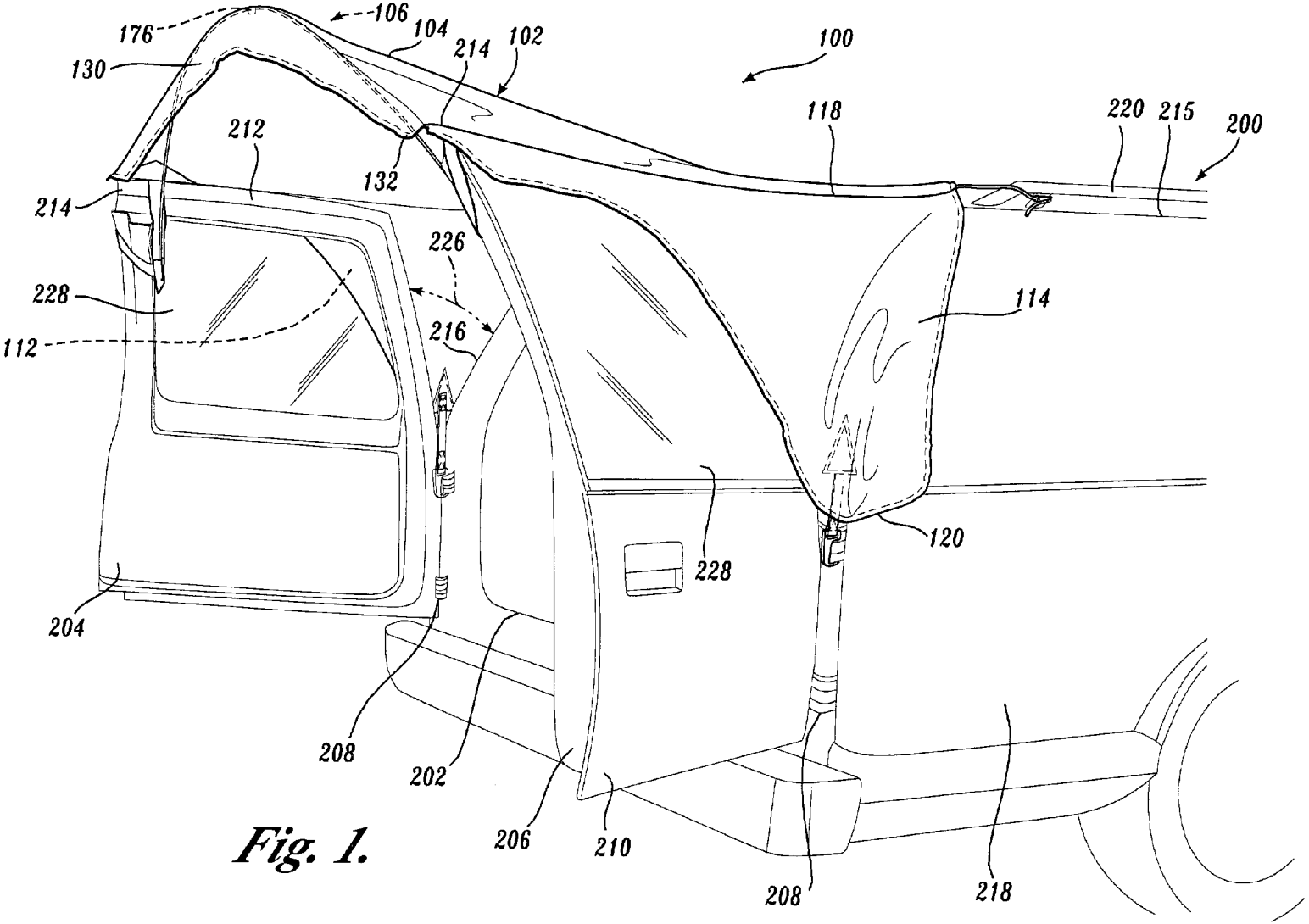
FIG. 1 is a perspective view of one embodiment of a canopy assembly formed in accordance with the present invention, the canopy assembly depicted in a deployed configuration while interfacing with a pair of cargo doors of a rear portion of a vehicle.
Figure 2:
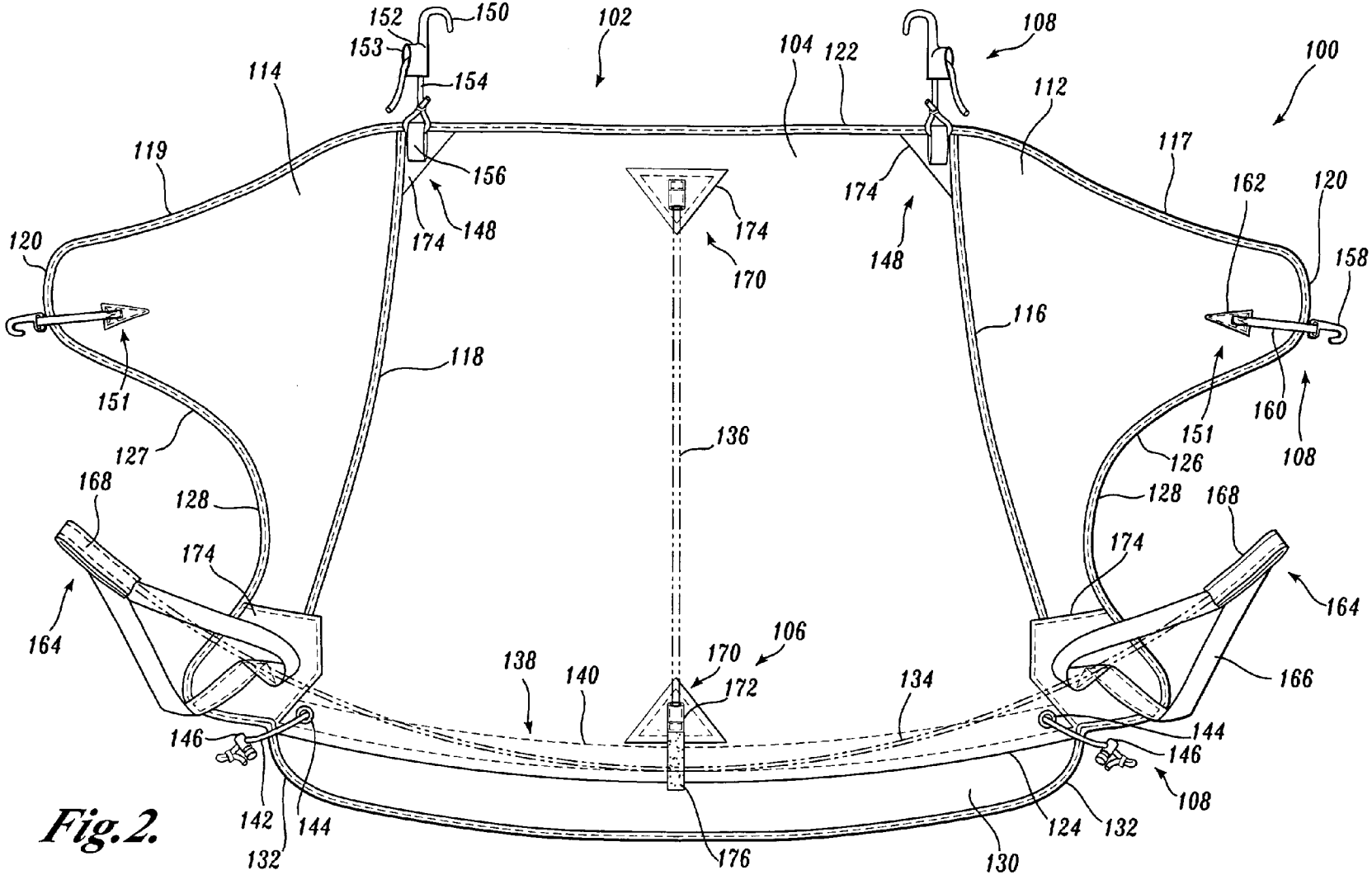
FIG. 2 is bottom plan view of the canopy assembly of FIG. 1 wherein the canopy assembly is depicted in a laid out or flat configuration for clarity.

FIGS. 1 and 2 illustrate one embodiment of a canopy 100 formed in accordance with the present invention. Generally described, the canopy 100 is designed to couple about an opening 202 in a vehicle 200 to provide protection from the elements for objects or persons in proximity to the opening 202. The canopy includes a flexible cover 102 supported by a support frame 106. An attachment assembly 108 couples the flexible cover 102 to the vehicle 200.

Focusing now upon the vehicle 200, the vehicle of the illustrated embodiment includes a first door 204 and a second door 206. The first and second doors 204 and 206 are each coupled in proximity to the opening 202 by a substantially vertically oriented hinge assembly 208. The first and second doors 204 and 206 may be pivoted about their respective hinge assembly 208 into an open position as depicted in FIG. 1. With the first and second doors 204 and 206 in their open positions, a user may access the interior of the vehicle 200 through the opening 202. Each door 204 and 206 further includes an outer surface 210 (one shown), a top edge 212 (one shown), and an upper distal door corner 214.

The vehicle further includes a first side 216, a second side 218, and a roof 215 with an attached roof rack 220.

The canopy 100 includes a flexible cover 102 having a top panel 104 that extends between the top edges 212 of the doors 204 and 206 and the roof 215. The flexible cover 102 further includes a first side panel 112 and a second side panel 114. The side panels 112 and 114 are coupled to the top panel 104 and are each formed to extend between one of the sides 216 and 218 of the vehicle 200 and one of the doors 204 and 206 of the vehicle 200. Configured as such, the first side panel 112 covers a first gap 226 extending between the first door 204 and the first side 216 of the vehicle 200. Similarly, the second side panel 114 covers a second gap (not shown) disposed between the second door 206 and the second side 218 of the vehicle 200, the second gap a mirror image of the first gap 226.

Each side panel 112 and 114 includes a top edge 116 or 118, a leading edge 117 or 119, and a trailing edge 126 or 127. The leading and trailing edges 117, 119, 125, and 127 are inclined relative to the top edges 116 and 118. The trailing edges 117 and 119 of each of the side panels 112 and 114 include an arcuate cutout 128. The cutout 128 in each side panel 112 and 114 is configured to provide visibility through a window 228 disposed in each door 204 and 206. More specifically, the cutouts 128 prevent the side panels 112 and 114 from blocking the windows 228 such that a user located between the doors 204 and 206 may look out through the windows 228 when the canopy 100 is mounted to the vehicle 200.

The first side panel 112 is coupled along a longitudinally oriented first side 116 of the top panel 104. The second side panel 114 is coupled along a longitudinally oriented second side 118 of the top panel 104. The first and second sides 116 and 118 of the top panel 104 are of a substantially greater length than a bottom edge 120 of either side panel 112 and 114, due to the inclination of the leading and trailing edges 117, 119, 125 and 127 relative to the sides 116 and 118 of the top panel 104. More specifically, the length of the first and second sides 116 and 118 of the top panel 104 are over twice as long as the bottom edge 120 of each of the side panels 112 and 114.

The top panel 104 is generally a four sided polygon. The top panel 104 includes a leading edge 122 and a trailing edge 124 located substantially parallel to one another and substantially perpendicular to the longitudinal axis of the vehicle 200. The leading edge 122 is substantially straight and the trailing edge 124 is arcuate in shape so as to bow outward from the center of the top panel 104. The first and second sides 116 and 118 extend substantially parallel to one another and between the leading and trailing edges 122 and 124. The first and second sides 116 and 118 are also arcuate in shape so as to bow inward toward the center of the top panel 104.

An eyebrow panel 130 is coupled to the top panel 104 along the trailing edge 124 of the top panel 104. The eyebrow panel 130 is generally arcuate in shape and includes two radiused corners 132. The eyebrow panel 130 is designed to be suspended from the trailing edge 124 of the top panel 104 to provide enhanced protection from the elements of the space in proximity to the opening 202 in the vehicle 200. Further, the eyebrow panel 130 aids in the retention of a first elongate support member 134 upon the top panel 104 by impeding the movement of the first elongate support member 134 outward from the vehicle 200. More specifically, when assembled, the seam between the eyebrow panel 130 and the top panel 104 at the trailing edge 124 forms an approximately 90 degree angle seam which blocks the outward movement of the first elongate support member 134.

The flexible cover 100 is suitably constructed from any flexible material. The flexible material may be water absorbent, water resistant, waterproof, clear, opaque, smooth, textured, etc. Preferably, the flexible material is a water-resistant or waterproof material that is at least partially opaque to impede the entrance of rain and excessive sun into the space adjacent the opening 202. In one working embodiment, the flexible material is constructed from waterproof, UV resistant, fire resistant, durable, flexible fabric such as a coated rip-stop nylon fabric. Although the flexible cover 102 is described as being formed from the attachment of various panels to one another, it should be apparent to those skilled in the art that the flexible cover may be suitable formed from a single piece of flexible material.

This detailed description will now focus on the support frame 106. The support frame 106 includes the first elongate support member 134 mentioned above and a second elongate support member 136. The first elongate support member 134 is positioned in proximity to the trailing edge 124 of the top panel 104. The first elongate support member 134 is designed to bend either permanently or selectively, in to an arcuate shape. The arcuate shape of the first elongate support member 134 is used to impart an arcuate shape to the top panel 104 to enhance the rain shedding capabilities of the top panel and to increase head room under the top panel for a user. Further, the first elongate support member 134 is bent to raise the elevation of the flexible cover 102 above the doors 204 and 206 such that any precipitation falling upon the flexible cover 102 rolls forward and is discharged to the roof 215 of the vehicle 200 or rolls off to the side panels 112 and 114.

The second elongate support member 136 is positioned along the longitudinal centerline of the top panel 104. The second elongate support member 136 is designed to form a ridge in the top panel 104 to enhance the rain shedding capabilities of the top panel 104 during prolonged or heavy precipitation events by imparting an A-frame shape to the flexible cover 102. The second elongate support member 136 is oriented substantially perpendicular to the first elongate support member 134, substantially perpendicular to the trailing and leading edges 122 and 124 of the top panel 104, and substantially parallel with the first and second sides 116 and 118 of the top panel 104. The second elongate support member 136 extends from adjacent the leading edge 122 to adjacent the trailing edge 124.

The first and second elongate support members 134 and 136 may be formed from any rigid or semi-rigid material. As stated above, the elongate support members 134 and 136 may be permanently formed into the arcuate shape they are configured in when the canopy 100 is installed, or alternately, and as preferred, the elongate support members 134 and 136 are selectively bent into a selected arcuate shape when the canopy is installed.

The elongate support members 134 and 136 may each be made from a single piece, or alternately, to reduce storage space, may be formed by assembling several lengths of the material in an end to end relationship. In one working embodiment, each elongate support member 134 and 136 is formed by several sections of aluminum hollow tube fastened to one another in an end to end fashion to form a flexible pole. A an elastic cord or shock cord runs through each of the aluminum hollow tubes, tying each piece to one another to ease installation. The design and operation of flexible poles is well known to those skilled in the art, especially those acquainted with tent pole construction, and therefore will not be described in further detail herein.

The canopy 100 further includes a tensioner 138. The tensioner 138 includes a sheath 140 partially housing a length of shock cord 142 therethrough. The shock cord 142 emerges from the sheath 140 through an eyelet 144 disposed at each end of the sheath 140. Coupled adjacent to each end of the shock cord 142 are lock fasteners 146 which may selectively lock upon the shock cord 142. By selectively controlling the length of shock cord disposed between the eyelets 144, a tension exerted upon the top panel 104 along the length of the sheath 140 may be selectively controlled. By selectively adjusting the tension in the top panel 104 with the tensioner 138, the flexible cover 102 may be kept taught over the first elongate support member 134.

The attachment assembly 108 further includes a pair of adjustable fasteners 148. Each adjustable fastener 148 includes a hook 150, a slotted cleat 152, a length of shock cord 154, and an attachment loop 156. The attachment loop 156 is coupled to a selected location on the top panel 104. One end of the length of shock cord 154 is affixed to the attachment loop 156. A second end of the length of the shock cord 154 is coupled to the hook 150 via the slotted cleat 152. The slotted cleat 152 selectively grips the shock cord 154, permitting a user to adjust the length of shock cord 154 extending between the selected location and the hook 150. More specifically, the slotted cleat 152 has a slot 153 with a tapered width. The length of shock cord 154 may be selectively jammed into the reduced width portion of the slot 153 to lock the shock cord 154 therein. To release the shock cord 154, the bitter end of the shock cord 154 is gripped and pulled to remove the shock cord 154 from the reduced width portion of the slot 153. The hook 150 is adapted to couple to the roof rack 220 of the vehicle 200 as will be described in further detail below. Although the hook 150 and cleat 152 are preferably integrally formed, it should be apparent to those skilled in the art that the hook 150 may be separated from the cleat 152. For instance, the hook or other fastener may be placed at a distal end of the cord 154 and the other end of the cord 154 may pass through the cleat, an attachment loop on the flexible cover 102, and back to a slot 153 on the cleat for selectively attaching the cord thereto, as depicted and described for the embodiment of FIGS. 4 and 5.

Although a specific adjustable fastener is depicted and described for the illustrated embodiment, it should be apparent to those skilled in the art that other adjustable fasteners are suitable for use with the embodiments of the present invention and are within the spirit and scope of the present invention. For instance, a length of flexible shock cord may be used having a hook at a distal end and attached to the flexible cover at the other end. The elastic nature of the flexible shock cord provides the adjustability of the adjustable fastener. Further, a cleat may be attached to the vehicle and a length of flexible shock cord attached to the flexible cover 102 may be selectively engaged with the shock cord. As should also be apparent to those skilled in the art, although the illustrated embodiments depict and are described with the use of elastic shock cord, it should be apparent that any type of elongate flexible members may be used, whether elastic in nature or not, without departing from the spirit and scope of the present invention.

Further still, although the illustrated embodiment is depicted as utilizing a hook 150 for coupling to the roof 215 via the roof rack 220 of the vehicle 200, it should be apparent to those skilled in the art that other attachment assemblies may be used. For instance, the attachment assemblies may include a flexible member, such as shock cord, coupled to suction cups attachable to the roof 215 of the vehicle, fabric hook and loop fastening assemblies which attached to the roof rack or other structure, bungi cords extending between the canopy 100 and the roof 215 of the vehicle 200, etc. Further, anchor locations on the roof 215 may be created by affixing a fastener to the roof 215. For instance, it should be apparent to those skilled in the art that fasteners, such as cleats or eyelets, may be attached to the roof 215 of the vehicle to permit the selective coupling of a flexible member, such as shock cord, between the fastener and the canopy 100.

The attachment assembly 108 further includes a pair of attachment devices 151. The attachment devices 151 each include a hook 158, a length of hook and loop fastening fabric 160, and an attachment base 162. The length of hook and loop fastening fabric 160 passes through a slot in the hook 158 and then is folded back upon itself, fastening the hook 158 to the length of hook and loop fastening fabric 160. Each of the attachment bases 162 is coupled to a selected location on one of the side panels 112 and 114. The hooks 158 are adapted to couple to the hinge assemblies 208 of the vehicle 200. The length of each of the attachment devices 151 is selectively adjustable by manipulating the distance between the attachment base 162 and the hook 158 prior to folding the length of hook and loop fastening fabric 160 back upon itself.

The attachment assembly 108 further includes a pair of securement devices 164. The securement devices 164 each include a fastening loop 166 and a sleeve 168. Each of the fastening loops 166 is coupled to a selected location on one of the side panels 112 or 114. The sleeves 168 are adapted to receive and end of the first elongate support member 134 therewithin such that the first elongate support member 134 spans between the pair of sleeves 168. Preferably, the distance between the sleeves 168 is less than the length of the first elongate support member 134 such that an arcuate shape or bend is imparted to the first elongate support member 134. Each fastening loop 166 is adapted to encircle one of the upper distal door corners 214 to couple the flexible cover 102 to the doors 204 and 206. The fastening loops 166 are made of flexible fabric such as nylon or polyester webbing. The fastening loops 166 are folded and twisted to lay flat and wrap around the door corners 214.

The attachment assembly 108 further includes a pair of retainment members 170. The retainment members 170 each include a socket 172 coupled to the top panel 104. Each socket 172 is adapted to received an end of the second elongate support member 136 to retain the second elongate support member 136 to the top panel 104. Preferably, the second elongate support member 136 is oriented substantially along the longitudinal center line of the top panel 104.

The attachment assembly 108 further includes a plurality of reinforcement pads 174. The reinforcement pads 174 impart enhanced strength to the flexible cover 102 at selected locations to aid in the attachment of the load bearing devices of the attachment assembly 108 to the flexible cover 102.

The attachment assembly 108 may further include a first elongate support member connector 176. The first elongate support member 134 is coupled to the flexible cover 102 and includes an elongate piece of hook and loop fabric fastener material. The connector 176 is adapted to couple the first elongate support member to the flexible cover 102 by folding back upon itself, thereby encircling the first elongate support member 134. In FIG. 2, the connector 176 is shown in a flat configuration prior to folding back upon itself to couple the first elongate support member 134 to the flexible cover 102. Although in the illustrated embodiment a connector 176 formed from well known hook and loop fabric is depicted, it should be apparent that the connector 176 may be formed in many different ways, such as passing the first elongate support member 134 through a permanent loop attached to the flexible cover 102, tying the first elongate support member 134 to the flexible cover 102 with rope, etc.

In light of the above description of the components of the canopy 100, the operation of the canopy 100 will now be described. The installation of the canopy 100 upon the rear of the vehicle 200 is initiated by opening of the first and second doors 204 and 206. The canopy 100 is attached to the vehicle 200 by engaging the hooks 150 of the adjustable fasteners 148 with the roof rack 220. The fastening loops 168 of the securement devices 164 are positioned to encircle the door corners 214, further coupling the canopy 100 to the vehicle 200. The first elongate support member 134 is inserted within its sleeves 168. The first elongate support member 134 may be attached to the flexible cover 102 by folding back the connector 176 upon itself to encircle the first elongate support member 134. The eyebrow panel 130 is pulled rearward over the first elongate support member 134. The attachment devices 151 are used to couple the side panels 112 to the vehicle 200 by engaging the hooks 158 with the hinge assemblies 208. The user may then adjust the tension in the canopy 100 by selectively adjusting the position of the lock fasteners 146 of the tensioner 138 and by adjusting the position of the shock cords 154 relative to the slotted cleats 153. If weather conditions or user preference warrants, the second elongate support member 136 may be inserted within its sockets 172.

In the installed configuration, the canopy 100 provides a partially enclosed enclosure for protecting a user from the elements. The enclosure is bounded by the top panel 104, first and second doors 204 and 206, a ground surface, the opening in the vehicle 202, and a non-closable rear opening and a non-closable bottom opening in the enclosure permitting walk-in access to the enclosure. Since the canopy 100 is coupled to the vehicle 200 so as to be suspended above a ground surface, the vehicle 200 may be moved to an alternate location with the canopy 100 installed to the vehicle 200, since the canopy 100 does not include a bottom panel that rests against the ground surface or attachments which couple the canopy 100 to the ground. The non-closable rear opening and non-closable bottom opening permits a user unfettered access to the enclosure without having to open an entranceway or worry about stepping upon a bottom panel. The user is free to stand in the enclosure, and egress and ingress the enclosure without obstruction. Removal of the canopy 100 is accomplished by reversing the above described steps.

Although the illustrated embodiment depicts and discloses a non-closable rear opening, it should be apparent to those skilled in the art that a privacy panel/screen may be attached to the flexible cover to provide a screenable or closable rear opening.

Figure 3:
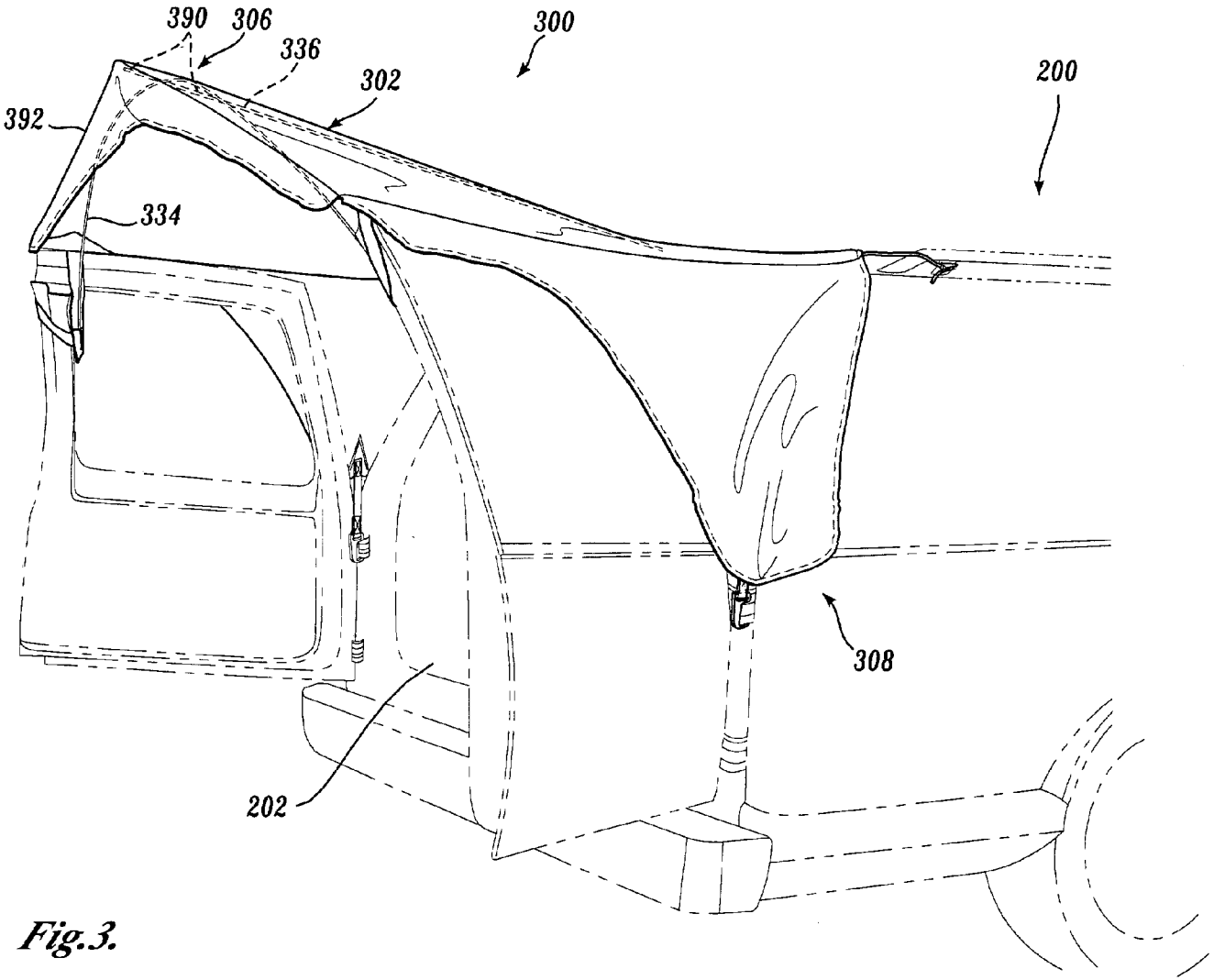
FIG. 3 is a perspective view of an alternate embodiment of canopy assembly formed in accordance with the present invention, the canopy assembly substantially similar to the canopy assembly depicted in FIGS. 1 and 2 with the exception that the canopy assembly includes an extension portion extending the canopy assembly an additional distance outward from the vehicle.

Referring to FIG. 3, an alternate embodiment of a canopy 300 formed in accordance with the present invention is provided. Generally described, the canopy 300 is designed to couple about an opening 202 in a vehicle 200 to provide protection from the elements for objects or persons in proximity to the opening 202. The canopy includes a flexible cover 302 supported by a support frame 306. An attachment assembly 308 couples the flexible cover 302 to the vehicle 200.

The alternate embodiment depicted in FIG. 3 is substantially similar to the embodiment depicted in FIGS. 1 and 2 in both construction and operation. Therefore, for the sake of brevity, the detailed description will focus only upon the distinguishing deferences between the two embodiments. Most notably, the length of the second elongate support member 336 has been increased so that the distal end of the second elongate support member 336 extends beyond the first elongate support member 334. The additional length 390 of the second elongate support member 336 forms an extension portion 392, extending the flexible cover 302 an additional distance outward from the vehicle 200 relative to the embodiment of FIGS. 1 and 2. The additional distance is equal to the additional length 390 of the second elongate support member 336. Further, the alternate embodiment of FIG. 3 does not utilize the tensioner 138 depicted and described for the embodiment of FIGS. 1 and 2.

Configured as described, the second elongate support member 336 is adapted to be oriented substantially perpendicular to the first elongate support member and substantially parallel with the longitudinal axis of the vehicle. Further, the second elongate support member 336 extends both outward from the first elongate support member 334 in a direction away from the opening 202 in the vehicle 200 and inward from the first elongate support member 334 in a direction toward the opening 202 in the vehicle 200.

Preferably, the second elongate support member 336 passes underneath the first elongate support member 334. Configuring the support members 334 and 336 as described aids in maintaining the first elongate support member in position, i.e. the second elongate support member 336 impedes the longitudinal movement of the first elongate support member 334 forward or aft. Although not depicted, it should be apparent that the elongate support members 334 and 336 may be tied to one another or coupled to the flexible cover 302 at the point of intersection without departing from the spirit and scope of the present invention. Further, although the second elongate support member 336 is described as passing underneath the first elongate support member 334, it should be apparent to those skilled in the art that that the second elongate support member 336 may also pass above the first elongate support member 334.

Figure 4:
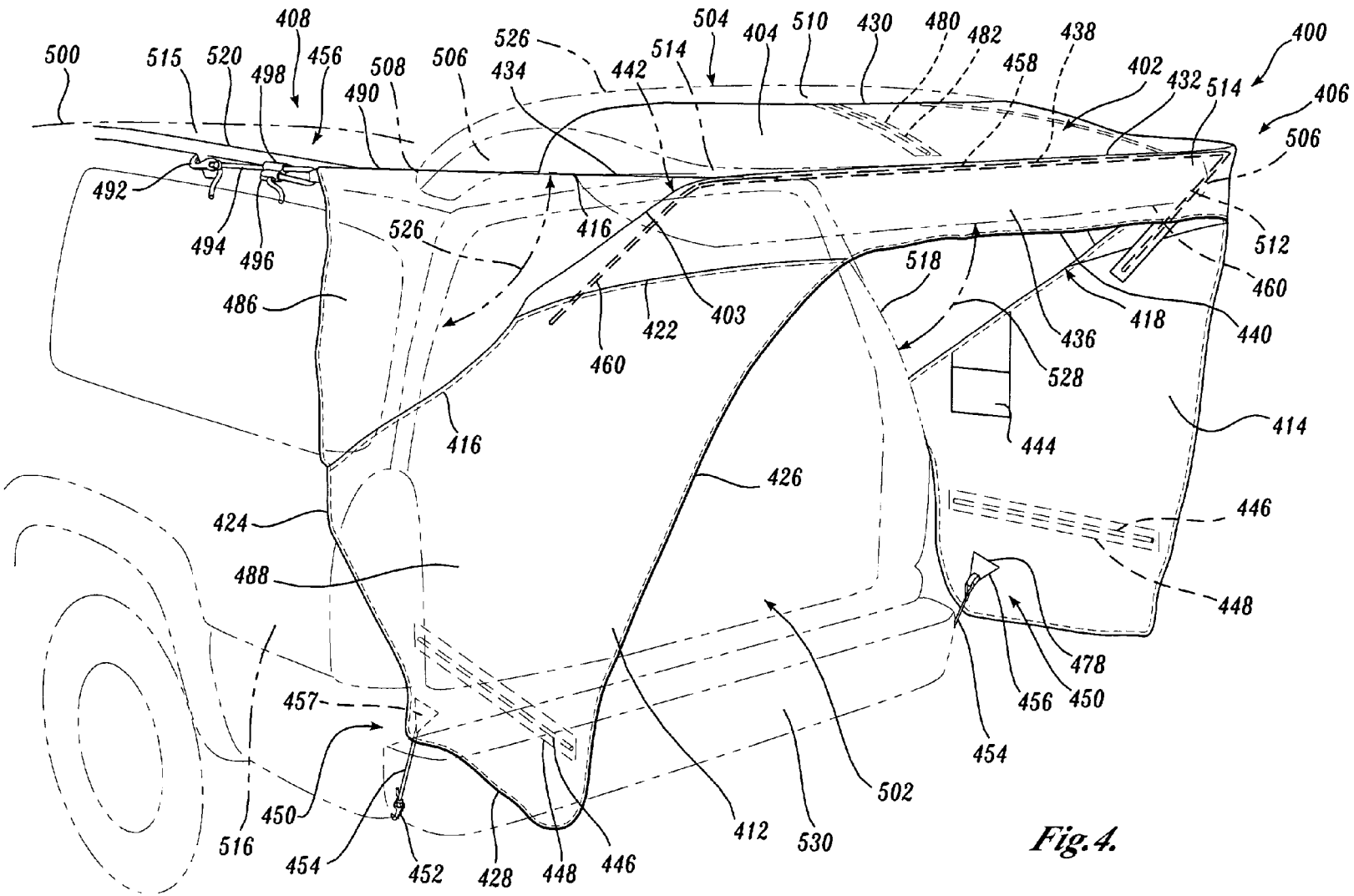
FIG. 4 is a perspective view of an alternate embodiment of a canopy assembly formed in accordance with the present invention, the canopy assembly depicted in a deployed configuration while interfacing with a liftgate of a rear portion of a vehicle.
Figure 5:
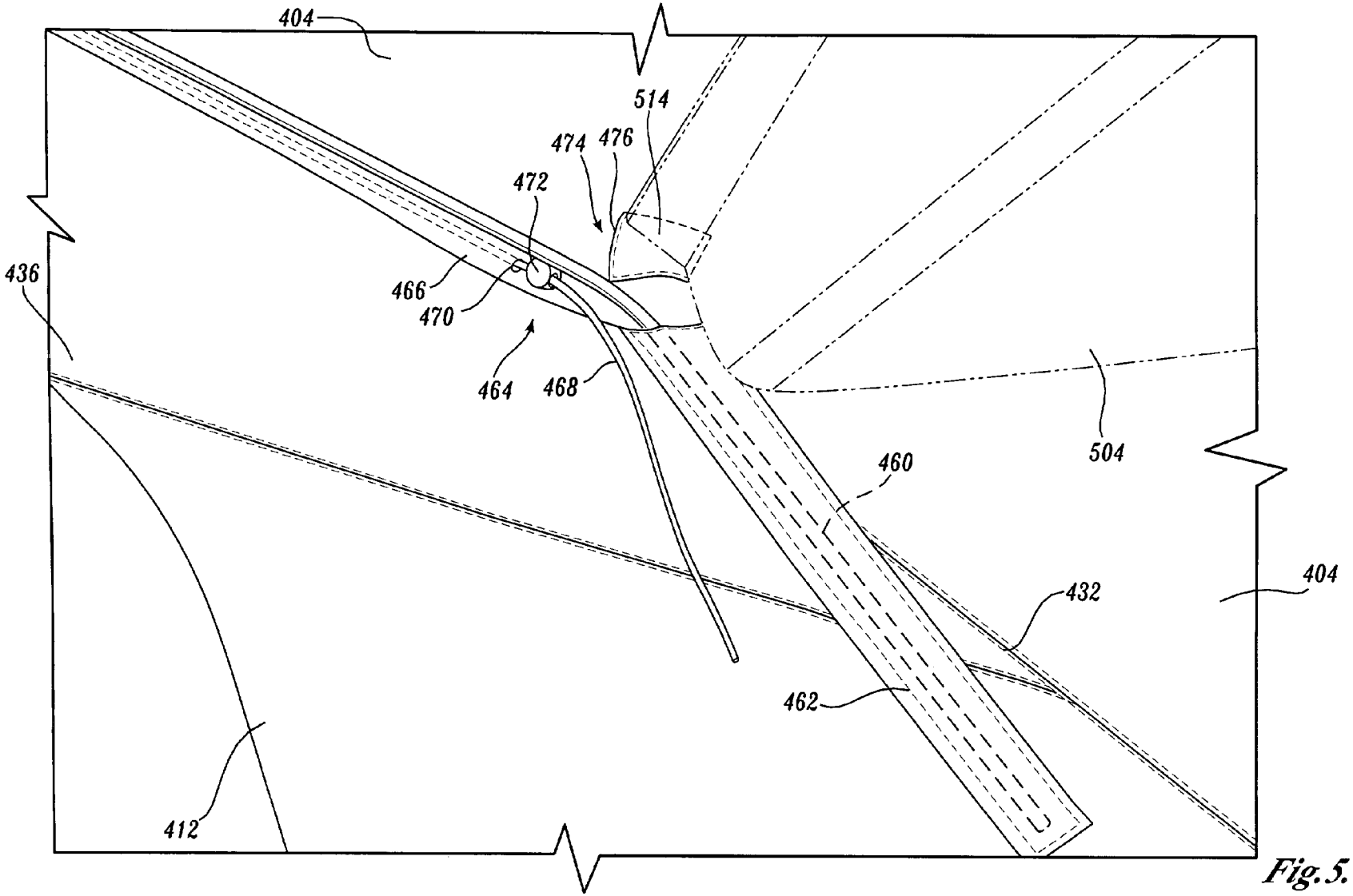
FIG. 5 is perspective view of a portion of an underside of the canopy assembly of FIG. 4, depicting the attachment of the canopy assembly to a corner of the liftgate and depicting the orientation and attachment of an elongate support member.

FIGS. 4 and 5 illustrate another alternate embodiment of a canopy 400 formed in accordance with the present invention. The alternate embodiment depicted in FIGS. 4 and 5 is similar to the embodiments depicted in FIGS. 1–3 in both construction and operation. Therefore, for the sake of brevity, the detailed description will focus only upon the distinguishing deferences between this embodiment and the previously described embodiments. Most notably, the alternate embodiment depicted in FIGS. 4 and 5 is adapted to interface with a vehicle 500 having a liftgate 504 in lieu of the cargo doors depicted in the previous embodiments.

Generally described, the canopy 400 is designed to couple about an opening 502 in a vehicle 500 to provide protection from the elements for objects or persons in proximity to the opening 502. The canopy includes a flexible cover 402 supported by a support frame 406. An attachment assembly 408 couples the flexible cover 402 to the vehicle 500.

Focusing now upon the vehicle 500, the vehicle of the illustrated embodiment includes a rear liftgate 504. The liftgate 504 is coupled in proximity to the opening 502 by a substantially horizontally oriented hinge assembly 508. The liftgate 504 may be pivoted about the hinge assembly 508 into an open position as depicted in FIGS. 4 and 5. With the liftgate 508 in the open position, a user may access the interior of the vehicle 500 through the opening 502. The liftgate 504 includes an outer surface 510, a bottom edge 512, a pair of opposing bottom liftgate corners 514, and a pair of opposite side edges 506. The vehicle further includes a first side 516, a second side 518, and a roof 515 with an attached roof rack 520.

Focusing now upon the flexible cover 402, the flexible cover has a top panel 404 that extends between the bottom edge 512 of the liftgate 504 and the roof 515. The flexible cover 402 further includes a first side panel 412 and a second side panel 414 coupled to the top panel 404. Each side panel 412 and 414 is constructed from an upper side panel 486 coupled to a lower side panel 488 about a first seam 416 or a second seam 418. The side panels 412 and 414 are coupled to the top panel 404 along one of two upper seams 490 (one shown) and are each formed to extend between one of the sides 516 and 518 of the vehicle 500 and the liftgate 504 of the vehicle 500. Configured as such, the first side panel 412 covers a first gap 526 extending between the liftgate 504 and the first side 516 of the vehicle 500. Similarly, the second side panel 414 covers a second gap 528 disposed between the liftgate 504 and the second side 518 of the vehicle 500.

Each side panel 412 and 414 is defined about its perimeter by the upper seams 490 (one shown), a lower eyebrow panel seam 422, an upper eyebrow panel seam 423, a leading edge 424, a trailing edge 426, and a bottom edge 428. The top panel 404 is defined about its perimeter by a leading edge 430, trailing edge 432, and by a pair of side edges 434. The eyebrow panel 436 is defined about is perimeter by a leading edge 438 and a trailing edge 440, the width of the eyebrow panel 436 tapering along its length such that the leading edge 438 and trailing edge 440 intersect at the ends of the eyebrow panel 436. The eyebrow panel 436 is designed to be suspended from the trailing edge 432 of the top panel 404 to provide enhanced protection from the elements of the space in proximity to the opening 502 in the vehicle 500. Further, the eyebrow panel 436 aids in the retention of an elongate support member 442 upon the top panel 404 by impeding the movement of the elongate support member 442 outward from the vehicle 500. More specifically, the seam between the eyebrow panel 436 and the top panel 404 at the trailing edge 432 of the top panel 404 forms an approximately 90 degree angle seam when the canopy 400 is installed, which blocks the outward movement of the elongate support member 442.

Coupled to the interior of the side panels 412 and 414 is a pocket 444. The pocket 444 is coupled to the second seam 418 so as to be suspended down from the second seam 418. The pocket may be made from any material and preferably from a flexible material, such as a mesh fabric to permit a user to view the contents of the pocket 444. Although the pocket 444 is depicted solely in the embodiment of FIGS. 4 and 5, it should be apparent to those skilled in the art that the pocket 444 may be coupled to any embodiment formed in accordance with the present invention.

A sheath 448 is coupled to each of the side panels 412 and 414. The sheaths 448 are preferably located substantially horizontal so as to extend outward from the opening 502 in the vehicle 500. The sheaths 448 are disposed substantially parallel with the bottom edges 428 of the side panels 412 and 414. Disposed within each sheath is a pole, batten, or stiffener 446. The stiffeners 446 enhance the rigidity of the side panels 412 and 414 so that the side panels 412 and 414 remain in position and are not unduly influenced by passing wind.

The flexible cover 400 is suitably constructed from any flexible material. The flexible material may be water absorbent, water resistant, waterproof, clear, opaque, smooth, textured, etc. Preferably, the flexible material is a water-resistant or waterproof material that is partially opaque to impede the entrance of rain and excessive sun into the space adjacent the opening 502. In one working embodiment, the flexible material is constructed from waterproof, UV resistant, fire resistant, durable, flexible fabric such as a coated rip-stop nylon fabric.

Focusing now upon the attachment assembly 408, the attachment assembly 408 includes a pair of attachment devices 450 and a pair of adjustable fasteners 456 (one shown). The attachment devices 450 are coupled in proximity to the intersection of the leading edge 424 and the bottom edge 428 of each side panel 412 and 414. Each attachment device includes a hook 452, a length of shock cord 454, and an attachment base 457. Each of the attachment bases 457 is coupled to a selected location on one of the side panels 412 and 414. The hooks 452 are adapted to couple to a lower portion of the vehicle 502, such as to the bumper 530 of the vehicle 500 or to a bottom edge of a body panel.

The adjustable fasteners 456 (one shown) are coupled to the flexible cover 402. The adjustable fasteners 456 include a hook 492, a length of shock cord 494, and a cleat having a slot 496 and a barrel 498. The hook 492 is adapted to coupled to the roof 515 of the vehicle 500, such as to a roof rack 520. The distal end of the shock cord 494 is coupled to the hook 492 and the other end of the cord 154 is passed through the barrel 498, an attachment loop on the flexible cover 402, and back to the slot 496 on the cleat for selectively attaching the shock cord 494 thereto.

This detailed description will now focus on the support frame 406. The support frame 406 includes an elongate support member 442. The elongate support member 442 is positioned in proximity to the trailing edge 432 of the top panel 404. The elongate support member 442 is designed to be selectively or preferably permanently bent into shape. The elongate support member 442 includes an arcuate cross member 458 having two substantially straight arms 460 extending outward from the cross member 458 at each end. The arms 460 are disposed at an angle of about 115 degrees to 165 degrees relative to the cross member 458 at the point each arm is joined to the cross member 458. Preferably, the arms 460 are disposed at an angle of about 145 degrees relative to the cross member 458 at the point each armed is joined to the cross member 458. By angling the arms 460 as described from the cross member 458, the side panels 412 and 414 are pushed outward, away from each other, increasing the room under the canopy 400. Further, as the elongate support member is installed, the arms 460 are displaced inward towards one another. This motion places a bending stress upon the cross member which tends to lock together a plurality of poles which make up the cross member 458 to one another, adding rigidity and stability to the elongate cross member 442 and canopy 100.

The arms 460 are coupled to the flexible cover through insertion of the arms 460 into sleeves 462 (one shown) coupled on the side panels 412 and 414. The elongate support member 442 is oriented so as to extend the trailing edge 432 of the top panel 404 above the elevation of the outer surface 510 of the liftgate 504. By raising the elevation of the trailing edge 432 as described, any precipitation falling upon the top panel 404 is directed forward to be discharged upon the roof 515 of the vehicle 500 or to the side to be discharged upon the side panels 412 or 414. The elongate support member 442 is of similar construction to the first and second elongate support members described for the embodiments of FIGS. 1–3, and therefore will not be described in further detail for the sake of brevity.

A ridge sheath 480 is positioned preferably and substantially along the longitudinal centerline of the top panel 404. A ridge pole, batten, or stiffener 482 is placed within the sheath 480 to enhance the rigidity of the top panel 404. The ridge stiffener 482 is designed to form a ridge in the top panel 404 to enhance the rain shedding capabilities of the top panel 404 during prolonged or heavy precipitation events by imparting an A-frame shape to the flexible cover 402. The ridge stiffener 482 aids in lifting the flexible cover 402 above the outer surface 510 of the liftgate 504. The ridge stiffener 482 is oriented substantially perpendicular to the cross member 458 and substantially perpendicular to the trailing and leading edges 430 and 432 of the top panel 404. The ridge stiffener 482 extends from adjacent the leading edge 430 to adjacent the trailing edge 432 of the top panel 404.

The canopy 400 further includes a tensioner 464. The tensioner 464 includes a sheath 466 partially housing a length of shock cord 468 therethrough. The shock cord 468 enters the sheath 466 through an eyelet 470 (one shown) disposed at each end of the sheath 466. Coupled adjacent to each end of the shock cord 468 are lock fasteners 472 (one shown), which may selectively lock upon the shock cord 468. By selectively controlling the length of shock cord 468 disposed between the eyelets 470, a tension exerted upon the top panel 404 along the length of the sheath 466 may be selectively controlled. By selectively adjusting the tension in the top panel 404 with the tensioner 468, the flexible cover may be kept taught over the elongate support member 442.

The attachment assembly 408 further includes a pair of securement devices 474 (one shown). The securement devices 474 each include a pocket 476 coupled to a selected location on the top panel 404 in proximity to the trailing edge 432 of the top panel 404. The pockets 476 are adapted to receive the corners 514 of the liftgate 504 to couple the flexible cover 402 to the liftgate 504. The pockets 476 may be constructed from any material, such as elastic or fabric web material, or rigid materials such as plastic. Although the illustrated embodiment depicts the use of securement devices 474, it should be apparent to those skilled in the art that the canopies lacking securement devices 474 for coupling the flexible cover 402 to the lift gate 504 are also within the spirit and scope of the present invention.

The attachment assembly 408 further includes a plurality of reinforcement pads 478. The reinforcement pads 478 impart enhanced strength to the flexible cover 402 at selected locations to aid in the attachment of load bearing devices of the attachment assembly 408 to the flexible cover 402.

Although not shown, the flexible cover 402 may include a tensioner disposed along the trailing edge 432 of the top panel 404 to apply tension to the flexible cover 402 in the vicinity of the cross member 458 of the elongate support member 438. The tensioner may be substantially similar to the tensioner 138 of the embodiment depicted in FIG. 1.

In light of the above description of the components of the canopy 400, the operation of the canopy 400 will now be described. The installation of the canopy 400 upon the rear of the vehicle 500 is initiated by opening of the liftgate 504. The canopy 400 is lifted into position. The canopy 400 is attached to the vehicle 500 by engaging one of the hooks of the adjustable fasteners 456 to the roof 515 of the vehicle 500, such as upon a roof rack 520 of the vehicle. One of the corners 514 of the liftgate 504 near the already attached adjustable fastener 456 is inserted within one of the pockets 476 of the securement devices 474, further coupling the canopy 400 to the vehicle 500. The remaining corner 514 of the liftgate 504 is inserted within the remaining one of the pockets 476 of the securement devices 474. A hook of the remaining adjustable fastener 456 is coupled to the roof 515 of the vehicle 500, such as upon a roof rack 520 of the vehicle 500. The elongate support member 442 is inserted within its respective sleeves 462. The attachment devices 450 are used to couple the side panels 412 and 414 to the vehicle 500 by engaging the hooks 452 with the bumper 530. The eyebrow panel 436 is pulled rearward over the elongate support member 438. The user may then adjust the tension in the canopy 400 by selectively adjusting the position of the lock fasteners 472 of the tensioner 464 and by adjusting the position of the shock cords relative to the slotted cleats of the adjustable fasteners 456.

In the installed configuration, the canopy 400 provides a partially enclosed enclosure for protecting a user from the elements. The enclosure is bounded by the top panel 404, first side panel 412, second side panel 414, a ground surface, the opening in the vehicle 502, and a non-closable rear opening and a non-closable bottom opening in the enclosure permitting walk-in access to the enclosure. Since the canopy 400 is coupled to the vehicle 500 so as to be suspended above a ground surface, the vehicle 500 may be moved (preferably slowly) to an alternate location with the canopy 400 installed to the vehicle 500, since the canopy 400 does not include a bottom panel that rests against the ground surface or attachments which couple the canopy 400 to the ground. The non-closable rear opening and the non-closable bottom opening permits a user unfettered access to the enclosure without having to open an entranceway. The user is free to stand in the enclosure, and egress and ingress the enclosure without obstruction. Removal of the canopy 400 is accomplished by reversing the above-described steps.

For the purposes of this detailed description, the term "substantially" when referencing a reference direction, such as a horizontal, vertical, perpendicular, parallel, etc. reference direction, shall be defined as an orientation that varies less than 45 degrees from the indicated reference direction. For instance, the term "substantially vertical" indicates that the inclination of the item in question deviates less than 45 degrees from a vertical orientation.

Although the illustrated embodiment depicts various panels as constructed from several sub panels, i.e. the side panels 412 and 414 of the embodiment depicted in FIG. 4, as constructed from a plurality of panels, it should be apparent that the panels may alternately be formed from a single panel. Further, although the flexible covers of the above illustrated and described embodiments are shown as constructed from multiple panels, it should be apparent to those skilled in the art that the flexible cover may be made from a single panel, or alternately, from a plurality of panels exceeding the number shown.

While the preferred embodiment of the invention has been illustrated and described, it will be appreciated that various changes can be made therein without departing from the spirit and scope of the invention.

The invention claimed is:

1. A canopy adapted to be suspended above an opening in a vehicle, the vehicle having a roof rack, a first side, a second side, a longitudinal axis, a first rear door, and a second rear door, each door having a hinge assembly and a top edge, each door being pivotable outwardly and rearwardly about their respective hinge assemblies to an open position to create an opening in the vehicle, the top edge of said doors when open each terminating in distal corners spaced from each other, the canopy when assembled comprising:

a flexible cover having a top panel adapted to extend between the top edges of the first and second door and the roof to form an enclosure bounded by the top panel and the first and second doors, said top panel having two forward outer corners and two rearward outer corners, said flexible cover having a rear opening permitting walk-in access to the enclosure, said flexible cover further comprising a first side panel attached to said top panel and extending downwardly for being placed on the outer side of at least a portion of the first door and a second side panel attached to the flexible cover extending downwardly for being placed along the outer side of at least a portion of the second door;

an attachment assembly for coupling the flexible cover to the vehicle, the attachment assembly including first and second adjustable fasteners attached to the flexible cover adjacent the forward outer corners of the top panel, said adjustable fasteners adapted to attach to the roof rack of the vehicle, said attachment assembly further comprising first and second adjustable side fasteners for fastening the lower portions of the first and second side panels, respectively, to portions of the vehicle, said attachment assembly further comprising first and second pocket members positioned adjacent the rearward corners of said top panel and adapted to be adjacent the distal corners of said doors, said pocket members adapted to fit over respective distal corners of said first and second doors, and a support frame coupled to the flexible cover to suspend the flexible cover above the ground between the distal corners of the first and second doors, said support frame including a first elongate flexible support member being fastened to said top panel and extending between said rearward corners, said first elongate flexible support member biasing said top panel in a sideward direction to maintain said doors in an open relationship, said first and second adjustable fasteners and said first and second adjustable side lower fasteners being tightened to tension the top panel and the side panels in position over the doors.

2. The canopy of claim 1, further comprising a pair of sleeves coupled to the flexible cover adjacent the respective rearward corners of the top panel, said sleeves each adapted to receive an end of said support member, said support member being flexible and resistant to bias said doors toward an open position.

3. The canopy of claim 2, wherein the support frame includes a second elongate support member supporting the first elongate flexible cover, the second elongate support member is oriented substantially perpendicularly to the first elongate flexible support member and substantially parallel with the longitudinal axis of the vehicle.

4. The canopy of claim 1, further comprising a tensioner adjustable in length, the tensioner spanning between two locations on the flexible cover, wherein adjusting the length of the tensioner selectively applies tension to the flexible cover.

5. The canopy of claim 1, wherein the top panel includes a trailing edge extending between the two rearward corners, the top panel including a tensioner adjustable in length and coupled in proximity to the trailing edge, the tensioner adapted to selectively apply a tension to the trailing edge.

6. The canopy of claim 1, wherein said first and second adjustable side fasteners are adapted to fasten the lower portions of said side panels to a portion of the hinge assembly of respective first and second rear doors.

7. A canopy adapted to be suspended above an opening in a vehicle, the vehicle having a roof rack, a first side, a second side, a longitudinal axis, a rear door, said door having a hinge assembly and a bottom edge, said door being pivotable outwardly and upwardly about its hinge assembly to an open position to create an opening in the vehicle, the bottom edge of said door when open having a distal edge terminating in spaced distal corners, the canopy when assembled comprising:

a flexible cover having a top panel adapted to extend between the distal edges of the door and overlying at least a portion of, said door, said top panel including two forward upper corners and two rearward corners, a first side panel attached to said top panel and extending downwardly from one side thereof and a second side panel attached to the top panel and extending downwardly from the other side thereof, said flexible cover forming an enclosure bound by the top and side panels, said flexible cover having a rear opening permitting walk-in access to the enclosure;

an attachment assembly for coupling the flexible cover to the vehicle, the attachment assembly including first and second adjustable fasteners attached to the flexible cover adjacent the forward upper corners of the side panels, said first and second adjustable fasteners adapted to attach to the roof rack of the vehicle, said attachment assembly further comprising first and second adjustable side fasteners for fastening the lower portions of the first and second side panels, respectively, to portions of the vehicle, said attachment assembly further comprising first and second corner assemblies positioned adjacent the rearward corners of said top panel and adjacent the distal corners of said door, said corner assemblies adapted to fit over respective distal corners of said door, and said top panel including a rearward edge adapted to be spaced rearwardly from the door, said top panel including an elongate flexible member adjustable in length coupled along said rearward edge and adjacent the two rearward corners for biasing and supporting a rearward portion of the top panel laterally and outwardly from the door to enlarge the canopy beyond the door.

8. The canopy of claim 7, further comprising a ridge stiffener, the ridge stiffener coupled to the top panel and oriented longitudinally to the vehicle, the ridge stiffener adapted to aid in supporting a portion of the top panel longitudinally outward from the door.

9. The canopy of claim 7, wherein said adjustable side fasteners are adapted to couple the first and second side panels to a bumper of the vehicle.

10. The canopy of claim 7, further including a first stiffener coupled to the lower portion of the first side panel to stiffen the first side panel and a second stiffener coupled to the lower portion of the second side panel to stiffen the second side panel.

* * * * *

UNITED STATES PATENT AND TRADEMARK OFFICE

CERTIFICATE OF CORRECTION

PATENT NO. : 7,108,005 B1
APPLICATION NO. : 10/447709
DATED : September 19, 2006
INVENTOR(S) : W.B. Christenson et al.

It is certified that error appears in the above-identified patent and that said Letters Patent is hereby corrected as shown below:

| COLUMN | LINE | ERROR |
|---|---|---|
| 15 (Claim 3, | 49 lines 2-3) | "wherein the support frame includes a second elongate support member supporting the first elongate flexible cover, the second elongate support member is oriented substantially perpendicularly to the first elongate flexible support member and substantially parallel with the longitudinal axis of the vehicle." should read --wherein the support frame includes a second elongate support member supporting the flexible cover, the second elongate support member is oriented substantially perpendicularly to the first elongate flexible support member and substantially parallel with the longitudinal axis of the vehicle.-- |
| 16 (Claim 7, | 39 line 35) | "said door, and" should read --said door; and-- |

Signed and Sealed this

Sixth Day of March, 2007

JON W. DUDAS
*Director of the United States Patent and Trademark Office*